United States Patent [19]

Henkin et al.

[11] 3,936,899

[45] Feb. 10, 1976

[54] AUTOMATIC SWIMMING POOL CLEANER

[76] Inventors: Melvyn L. Henkin, 19640 Greenbriar Drive, Tarzana, Calif. 91356; Jordan M. Laby, 3940 Davana Road, Sherman Oaks, Calif. 91403

[22] Filed: Mar. 7, 1974

[21] Appl. No.: 448,817

Related U.S. Application Data

[62] Division of Ser. No. 275,173, July 26, 1972, abandoned.

[52] U.S. Cl. ..... 15/1.7

[51] Int. Cl.[2] ..... F04H 3/20

[58] Field of Search ..... 15/1.7, 387; 114/222; 180/1 R, 1 VS, 7 T, 66 R

[56] References Cited

UNITED STATES PATENTS

| | | | |
|---|---|---|---|
| 1,466,315 | 8/1923 | Thorsen | 15/1.7 UX |
| 2,314,675 | 3/1943 | Wilson | 180/66 R |
| 3,238,549 | 3/1966 | Burlin et al. | 15/1.7 |
| 3,551,930 | 1/1971 | Myers | 15/1.7 |

FOREIGN PATENTS OR APPLICATIONS

| | | | |
|---|---|---|---|
| 9648/27 | 9/1927 | Australia | 15/1.7 |

*Primary Examiner*—Edward L. Roberts
*Attorney, Agent, or Firm*—Lindenberg, Freilich, Wasserman, Rosen & Fernandez

[57] ABSTRACT

An automatic swimming pool cleaner comprised of a car adapted to travel underwater along a random path on the pool vessel surface for dislodging debris therefrom. The car wheels are driven by a water powered turbine to propel the car in a forward direction, along the vessel surface. In order to prevent the car from being driven into a position, as for example against a vertical wall, from which it cannot emerge, a wheel geometry is employed which, upon contact, develops a horizontal force component parallel to the vertical wall, to thus enable the car to spin off. Alternatively, or in combination, a water flow produced reaction force can produce a torque to turn the car with respect to the engaged wheel to enable the car to spin off. The car is designed with a low center of gravity and a relatively buoyant top portion so as to produce a torque which maintains the car correct side up when on the pool bottom. Means are provided on the car for producing a water flow having force component perpendicular to the vessel surface to provide good traction between the car wheels and the vessel surface. Further, a water flow produced suction is created adjacent to the vessel surface for collecting debris into a basket carried by the car. In addition, one or more hoses is pulled by the car and whipped by water flow to sweep dirt from the vessel surface.

24 Claims, 10 Drawing Figures

MAIN PUMP & FILTER
BOOSTER PUMP 27
70
22
21
164
28
166
160
69
24
10
162
30
96
19
20
18
12
26
14
16

30
124
100
102
96
91
32
90
3
3
36a
36b
34
36c

AUTOMATIC SWIMMING POOL CLEANER

This is a division of application Ser. No. 275,173, filed July 26, 1972, now U.S. Pat. No. 3,822,754.

BACKGROUND OF THE INVENTION

This invention relates generally to an automatic swimming pool cleaner and more particularly to a cleaner comprised of a car adapted to travel underwater along a random path on the surface of a pool vessel.

Many different types of apparatus are disclosed in the prior art for cleaning swimming pools. An example of U.S. Pat. No. 3,291,145 which discloses a cleaner employing a floating head carrying high pressure liquid dispensing hoses which sweep the pool vessel walls so as to put any dirt thereon in suspension where it can be filtered out by the pool's standard filtration system. As further examples, U.S. Pat. No. 2,923,954 and 3,108,298 disclose cleaners in which wheeled vehicles move underwater along the pool vessel surface to collect debris and sweep the walls.

Prior art underwater cleaners have thus far met with only limited success for several reasons. Initially, in order to develop adequate traction between the wheels and pool vessel surface, they have typically had to be very heavy and cumbersome. Moreover, those underwater cleaners which employ an electric motor have proved to be somewhat inconvenient because of the potential shock hazard. That is, since it is normally recommended that the motor not be operated while there are swimmers in the pool, the cleaner cannot safely be left in the pool under the control of a time clock. As a consequence, the use of such cleaners has, for the most part, been restricted to commercial applications.

Further, it is characteristic of most prior art underwater cleaners to utilize relatively complex reversing and steering mechanisms in order to achieve adequate surface coverage. Such complex mechanisms are generally costly and relatively unreliable.

In view of the foregoing, it is an object of the present invention to provide an improved underwater swimming pool cleaner.

SUMMARY OF THE INVENTION

Briefly, the present invention is directed to a swimming pool cleaner including a car adapted to travel underwater along a random path on the pool vessel surface. The car is supported on power driven wheels which frictionally engage the vessel surface to drive it in a forward direction. In accordance with an improvement aspect of the invention, means are provided on the car for developing one or more water flows having a force component perpendicular to a plane tangential to the wheels and vessel surface. The water flows can, in addition, produce a forwardly directed force component which aids in propulsion and facilitates the climbing or spinning off of a vertical surface when encountered.

In accordance with a further aspect of the invention, a car wheel geometry is employed which produces a sidewise force component when the car wheels engage a vertical surface to thus cause the car to spin off and free itself from the surface without necessitating a reversal of driving direction.

In accordance with a still further aspect of the invention, the car structure is configured so that its center of gravity is close to the bottom of its vertical dimension so as to produce a torque tending to maintain it correct side up when on the pool bottom.

In accordance with a still further aspect of the invention, one or more hoses are coupled to the car and whipped by water flow therethrough to sweep the vessel surface and put any dirt thereon in suspension.

In accordance with a still further aspect of the invention, means are provided on the car for producing a suction adjacent to the vessel surface for pulling debris into a collection basket or bag carried by the car.

In a preferred embodiment of the invention, the car is formed of a platform supported on three wheels which engage the pool vessel surface. Two of the wheels are driven through gearing by a turbine which in turn is powered by water flowing thereto through a supply hose. In order to achieve the aforementioned spinoff effect, the two driven wheels are mounted for rotation about parallel, but spaced, axes. As a consequence, the leading edges of the driven wheels lie on a line which is not perpendicular to their direction of travel thus enabling the car to spin off obstructions and steep surfaces. The third wheel is mounted for rotation on an axis which pivots in a plane parallel to the plane tangential to the wheels so that this third wheel may be differently oriented for different pool surface slopes, thereby helping to randomly steer the car. Alternatively, positive drive means such as a linkage to the turbine can be provided to gradually pivot the third wheel or vary the discharge angle of a water jet to assure random car movement.

The water flow producing a force component perpendicular to the vessel surface is preferably developed by diverging a low volume, high velocity water flow from the supply hose to an orifice to thus pull water into the lower end of a venturi having a directional component extending perpendicular to the car platform which water is then discharged at the venturi's upper end. The force reaction presses the wheels against the pool vessel surface to thus develop significantly greater traction for propulsion than the weight of the car alone could provide As a consequence, the car can be constructed of relatively light and low cost materials and have the capability of climbing vertical surfaces. The suction produced adjacent the vessel surface by the water being pulled into the lower tube end draws debris from the pool surface into a collection basket carried by the car. Although a single water flow is used in the preferred embodiment of the invention for providing the primary hold down force as well as suction for picking up debris, it will be readily recognized that separate flows could be provided for this purpose if desired.

In accordance with another aspect of the invention, a portion of the water supply is diverted through the trailing sweep hoses to randomly whip them against the pool vessel surface.

In accordance with a still further aspect of the invention, means are provided within the collection basket for pulverizing leaves so that the remains can then be discharged and put in suspension in the pool water for later removal by the main filter system.

DESCRIPTION OF THE PREFERRED EMBODIMENT

Figure 1:
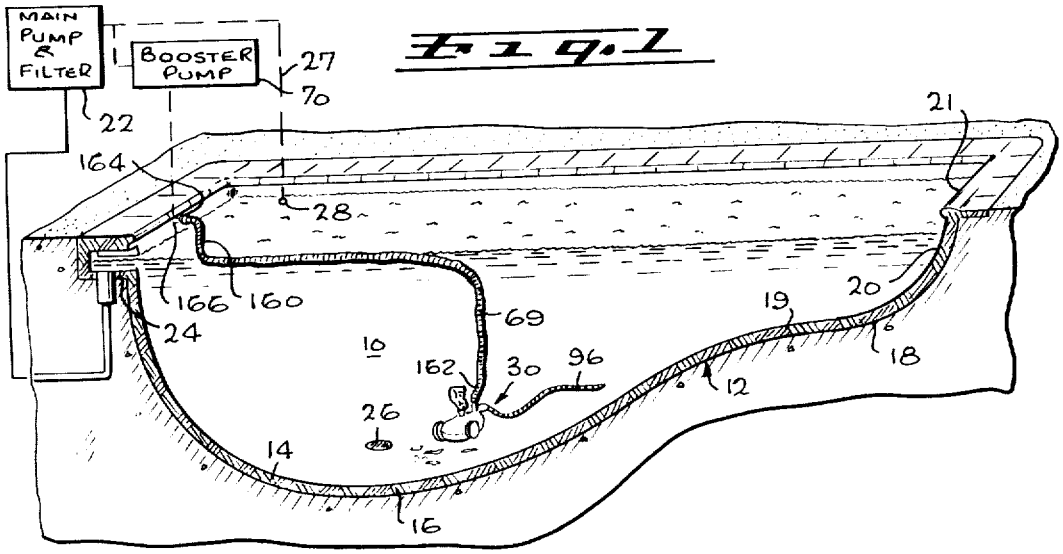
FIG. 1 is an isometric sectional view illustrating a pool cleaner in accordance with the present invention in a typical swimming pool.
Figure 2:
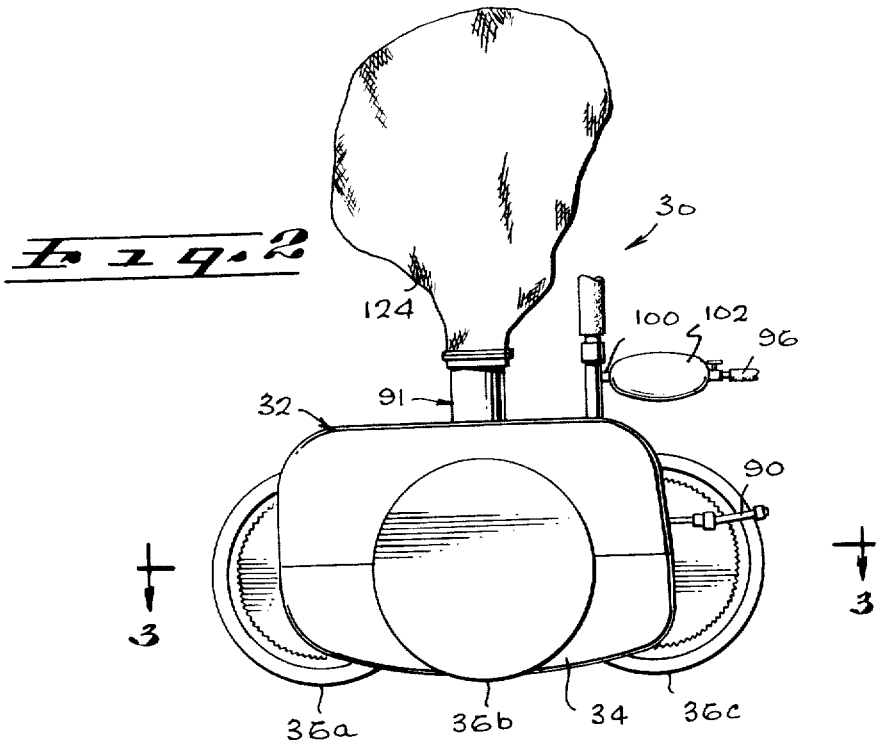
FIG. 2 is a side elevation view of a preferred embodiment of the present invention.

Attention is now called to FIG. 1 which illustrates a cutaway isometric view of a typical residential or commercial swimming pool. The water 10 is contained within a vessel 12 generally defined by a reinforced concrete wall 14 poured to conform to the shape of an excavated hole. Typically, a hole is excavated which defines a relatively deep end 16 and a relatively shallow end 18. In conforming to the shape of the excavation, the wall 14 generally defines substantially horizontal or floor portions 19 as well as substantially vertical or wall portions 20 which rise above the intended level of the water 10 to decking or coping 21.

Typically, filtration systems employed with swimming pools of the type illustrated in FIG. 1 include a main pump and filter 22 for taking water from the pool, filtering the water, and returning the filtered water to the pool. Such filtration systems employ water intake ports, such as a surface or skimmer intake 24 and a below water level drain intake 26. The filtration system sucks water into the intakes 24 and 26, and after filtration, returns the water to the pool via a return line 27 and return ports 28 extending through the vertical wall portion 20 close to the water line.

Although the typical swimming pool filtration system does quite an adequate job of filtering the water to remove fine debris particles suspended therein, such systems are not effective to remove debris, such as leaves, which settle on the floor of the panel or fine particles of debris which settle on both the floor and vertical wall portions of the pool vessel surface. As a consequence, in order to maintain a swimming pool clean, it is necessary to periodically sweep the wall surface, as with a longhandled brush, to place any fine debris in suspension. Additionally, it is also necessary to periodically vacuum the pool floor to remove larger debris such as leaves.

The present invention is directed to a cleaning apparatus 30 which travels along a random path on the surface of the pool vessel to both sweep the walls and suck debris into a debris container carried thereby.

Attention is now called to FIGS. 2–7 which illustrate a preferred embodiment of pool cleaner in accordance with the present invention.

Figure 4:
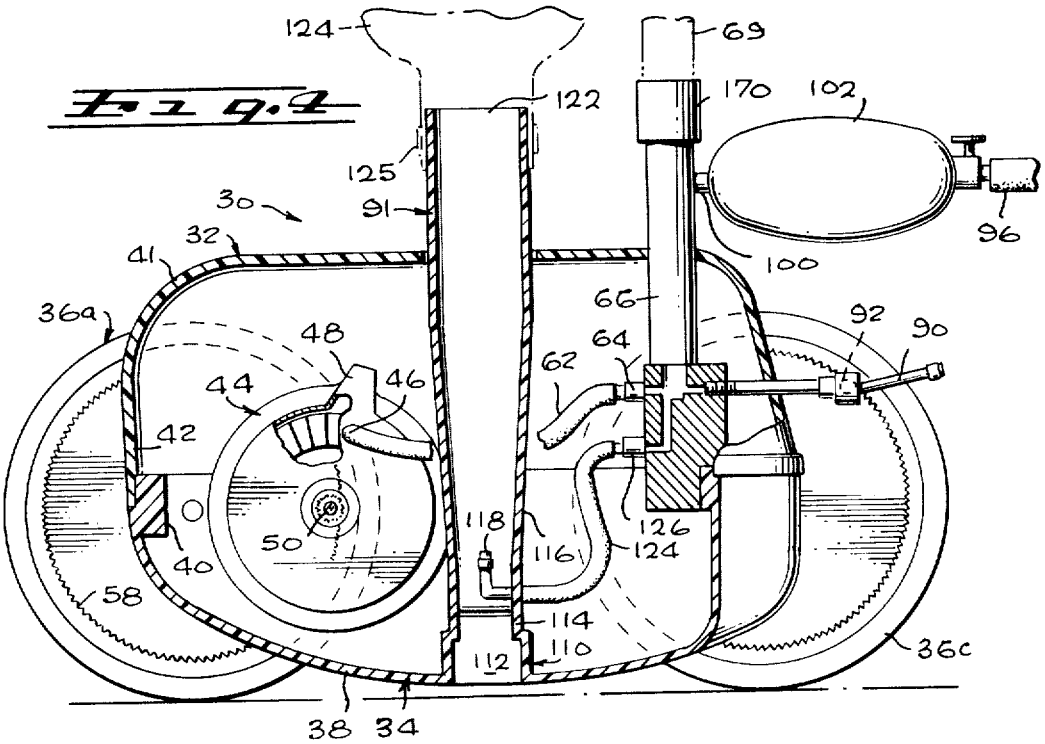
FIG. 4 is a side view, partially broken away, of a pool cleaner in accordance with the present invention.
Figure 5:
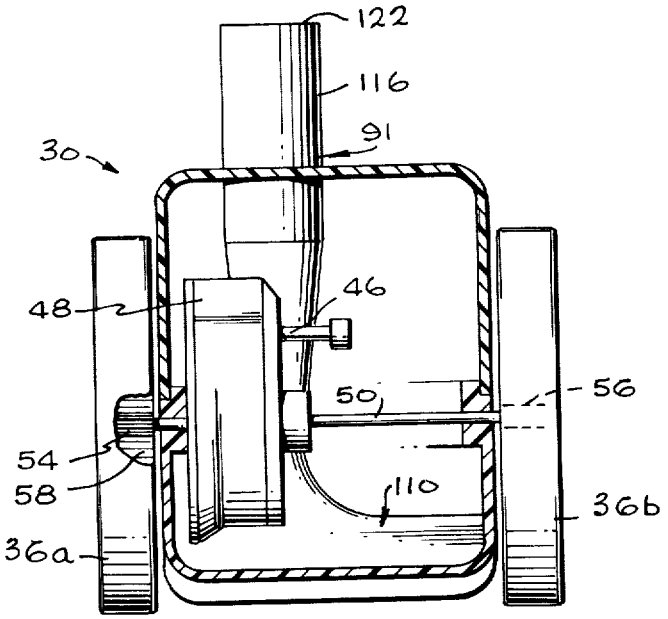
FIG. 5 is a sectional view taken substantially along the plane 5—5 of FIG. 3.
Figure 7:
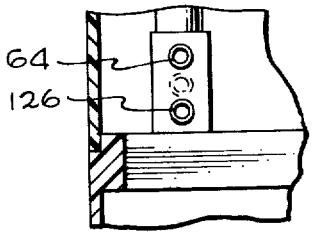
FIG. 7 is a sectional view taken substantially along the plane 7—7 of FIG. 3.
Figure 6:
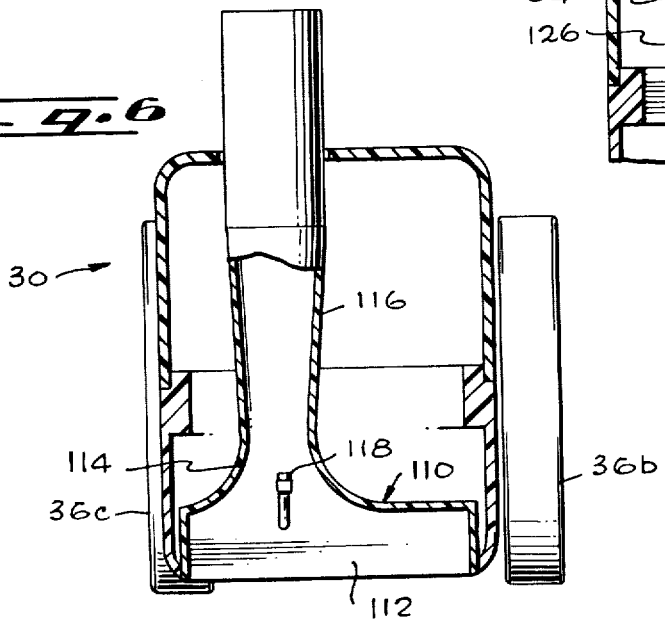
FIG. 6 is a sectional view taken substantially along the plane 6—6 of FIG. 3.

The pool cleaner 30 is comprised of a car 32 having a frame or body structure 34 supported on some type of movable traction means such as wheels 36*a*, 36*b*, 36*c*. As shown in FIG. 4, the frame structure 34 can be essentially pan shaped, consisting of a bottom plate or platform 38 and upstanding sidewall 40 extending around the periphery thereof. A dome or cover member 41 is provided having depending sidewalls 42 which mate with upstanding sidewall 40.

In accordance with the present invention, a turbine mechanism 44 is mounted within the frame structure 34 for producing rotary motion in response to a pressured water/flow supplied thereto. The turbine 44 can be conventional in design having a water inlet port 46, a water outlet port 48, and a power output shaft 50 which is rotated in response to water being supplied to the port 46.

Figure 3:
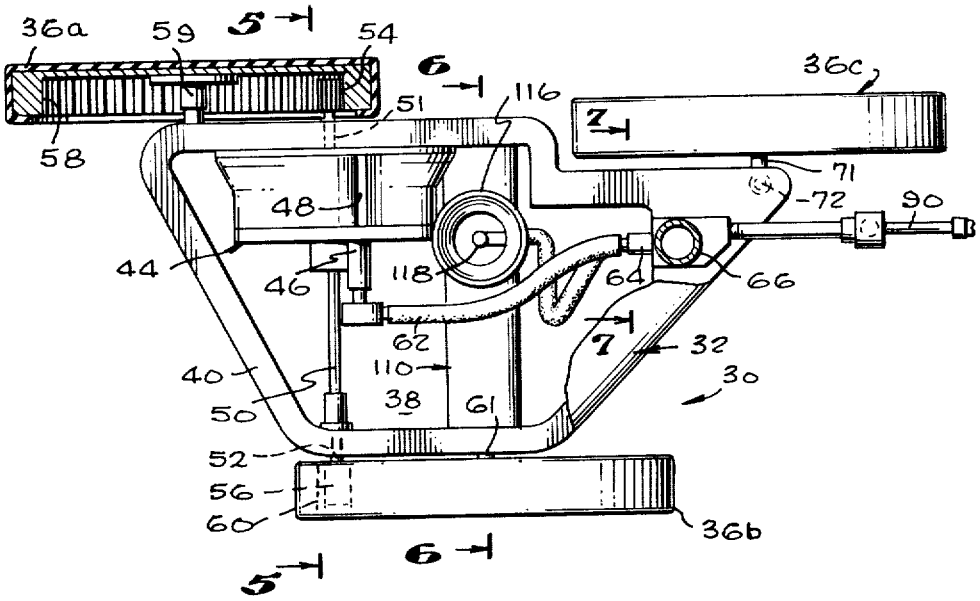
FIG. 3 is a sectional view of a pool cleaner in accordance with the present invention taken substantially along the plane 3—3 of FIG. 2.

The output shaft 50 extends axially in both directions from the turbine 44 and is supported for rotation in openings through wall portions 51, 52. Small gears 54, 56 are secured to the shaft 50 at opposite ends thereof. The gear 54 is engaged with an annular rack 58 formed on the inner surface of wheel 36a as is best shown in FIGS. 3 and 4. The wheel 36a is mounted for rotation on axle 59 which extends parallel to, but is spaced from, shaft 50. The gear 56 is similarly engaged with annular rack 60 formed on the inner surface of wheel 36*b* mounted for rotation on axle 61. Axle 61 also extends parallel to shaft 50 but is spaced therefrom in the direction opposite from axle 59. In contrast to the drive or traction function performed by wheels 36*a* and 36*b*, wheel 36*c* is merely a support wheel, as shown in FIGS. 3 and 4 mounted for rotation about axle 71. Axle 71 can be mounted for pivotal movement about pin 72 to better enable the wheel 36c to follow the contour of the vessel surface.

The turbine 44 is powered by water supplied to the port 46 via conduit 62 coupled to outlet 64 of a water supply mainfold 66. A pressurized water/flow is supplied to the inlet 68 of the manifold 66 through a supply hose 69 preferably from a booster pump 70 (FIG. 1). As the turbine 44 rotates to drive the shaft 50, both the wheel 36*a* and the wheel 36*b* will rotate.

It will be noted from FIG. 3 that although the wheels 36*a* and 36*b* rotate about parallel axes, the axes are offset with respect to one another. In other words, a line projected between the axes of wheels 36*a* and 36*b* will be skewed with respect to the planes of rotation of the wheels. As a consequence of this skew arrangement, the car will avoid getting stuck against vertical walls or barriers. That is, in its random travel along the pool vessel surface, even if the wheels 36*a* and 36*b* simultaneously engage a large obstacle such as the vertical wall of a step, the skewed relationship of the wheels 36*a* and 36*b* relative to the direction of travel will produce a force component extending parallel to the vertical wall to thus enable the car to spin off and thus avoid getting stuck in a position from which it cannot emerge.

It will be recalled from FIG. 1 that the wall 14 of a typical pool is shaped with a relatively large radius of curvature between the substantially horizontal or floor portions of the pool vessel and the substantially vertical or sidewall portions. In other words, for structural integrity and to facilitate water flow, many modern pools are not constructed with sharp corners between floor and wall. In order to most effectively clean a pool, it is desirable of course that the car be able to traverse as much of the pool vessel surface as possible. In other words, it is desirable that the car be able to climb the substantially vertically oriented portions of the pool vessel wall. In order to accomplish this, the car 32 in accordance with the present invention is provided with water powered means for producing a thrust to increase traction between the wheels 36 and the vessel surface. In accordance with the preferred embodiment of the invention, this thrust is produced by a water jet discharged from a directionally adjustable nozzle 90 and by a water stream discharged from a suction or vacuum unit 91. The two thrust components produce a substantial force extending normal to the vessel surface thereby increasing traction between the wheels 36*a*, 36*b*, 36*c* and the vessel surface and enabling the car to climb vertical surfaces.

The nozzle 90 is preferably mounted on some type of universal fitting such as a ball coupling 92 which couples the nozzle to the supply manifold 66 for receiving a high pressure water supply from booster pump 70. The angle of the nozzle 90 is selected to yield both a downward thrust component (i.e. normal to the vessel surface) for providing traction and a forward component which aids in propelling the car and facilitates the car climbing vertical surfaces and working itself out of corners. Set means (not shown) can be provided for holding the selected angle of the nozzle and valve means (not shown) can be provided for varying the flow rate through the nozzle 90.

In use, as the car is propelled along the vessel surface by rotation of the drive wheels 36a and 36b, the vacuum unit 91 will always discharge a water flow having a component normal to the portion of the vessel surface on which the car then rests. The intensity of the water flow is selected to produce a reaction force sufficient to enable the car to climb vertical surfaces. As the car climbs, the combined effects of gravity, the cars inherent flotation characteristics and the directional variations produced by the water jet (and other effects to be discussed) cause a change in direction of travel causing the car to fall off the vertical surface and reestablish its travel along another path. In order to assure that the car lands correct side up, the car is designed to have a relatively low center of gravity; i.e. the weight distribution of the car is selected so that its center of gravity is close to the bottom of its vertical dimension, so as to thereby produce a bouyant torque tending to maintain its correct side up. The entire car structure is preferably designed to weigh very little when underwater, thereby assuring that the hold down force produced by the water flow together with the weight distribution of the car, will cause the car to land correct side up whenever it falls from a wall surface.

The car carries with it one or more sweep hoses 96 which are trailed along and whip against the vessel surface. More particularly, a hose 96 is coupled to a tube 100 communicating with the interior of the supply manifold 66. The remote end of the hose 96 is left open via an orifice. Water flowing from the manifold 66 and tube 100 through the hose 96 will exit through the open hose end and in so doing will produce a reaction force on the hose whipping it in random directions. As a consequence, it will rub against and sweep fine debris from the vessel surface, putting it in suspension for removal by the pools standard filtration system. A float 102 is preferably mounted around the tube 100 to facilitate dynamic balance of the car. A valve 104 is preferably incorporated in the tube 100 for controlling the flow rate to the sweep hose and thus the whipping action thereof.

In the course of moving along a random path on the pool vessel surface in a manner thus far described, it is of course the function of the cleaner to clean the surface as by putting fine debris thereon in suspension for removal by the standard filtration system.

In addition, in accordance with the invention, large debris such as leaves are collected by the subject cleaner by the vacuum unit 91 which produces a suction close to the pool vessel surface. More particularly, a suction or vacuum head 110 (FIGS. 3 and 4) extending across substantially the full width of the car between the wheels 36*a* and 36*b* is defined in the plate 38. The suction head 110 defines a suction opening 112 at the bottom thereof. The opening 112 narrows down and communicates with the lower end 114 of a venturi tube 116. An orifice 118 is mounted in the thrust of the venturi tube 116 for discharging a flow of water therethrough toward the open end 122 of the venturi tube. Orifice 118 receives water flow via conduit 124 coupled to outlet 126 on the supply manifold 66. As should be appreciated, the water discharged from the orifice 118 produces a reduced pressure in the throat area of the venturi tube thus producing a suction at the entrance opening 112. As a consequence, water and debris are drawn from the vessel surface into the opening 112 and through the venturi tube 116. The water and debris are then discharged through the open venturi end 122 into a debris collection container. In the embodiment of the invention illustrated in FIGS. 2–7, the debris collection container constitutes a bag 124 formed of mesh material having an entrance opening sealed around the open end 122 of the venturi tube 116 by a band 125. The bag 124 is of course removable from the venturi tube 116 for cleaning or disposal.

Reference was previously made to a supply hose 69 for supplying a pressurized water flow to the manifold 66. In order to assure that the car does not get entangled with the supply hose 69, it is preferable that the hose float during operation as is represented in FIG. 1. The hose of course can be cause to float by mounting suitable floats thereon. More particularly, the supply hose 69 can comprise a one-half inch inner diameter plastic hose, for example, having a swivel coupling 164 mounted in a first end 160 thereof. The swivel coupling 164 is adapted to be threaded into an outlet 166 provided in the pool vessel surface adjacent to the water surface. A water booster pump 70 which can divert water out of the pool's standard filtration system, provides a high pressure flow to the outlet 166. The second end 162 of the hose 69 is coupled by a similar swivel coupling 170 to the previously mentioned supply manifold 66.

From the foregoing, it will be recognized that a swimming pool cleaner has been disclosed herein which is comprised of a car which travels along a random path on the surface of a pool vessel propelled by traction wheels powered by a water driven turbine. As a consequence of employing the previously discussed water streams to produce a significant traction force between the wheels and the vessel surface, the car can be constructed of light-weight inexpensive materials, such as plastic. By being able to utilize light weight materials such as plastic, a car in accordance with the invention can be produced quite inexpensively. Moreover, by designing the car so as to assure full coverage of the pool vessel surface without requiring complex steering and reversing mechanisms, cost reduction and reliability improvement is further enhanced. Although a particular embodiment of the invention has been illustrated in FIGS. 2–7, it should be readily apparent that many variations can be made without departing from the spirit or scope of the invention. Thus, for example only, an alternative arrangement is shown in FIGS. 8–10 wherein, in lieu of utilizing a separate debris collection bag, the car structure itself forms the debris container with the car cover member 200 being perforated to permit water flow therethrough.

Figure 8:
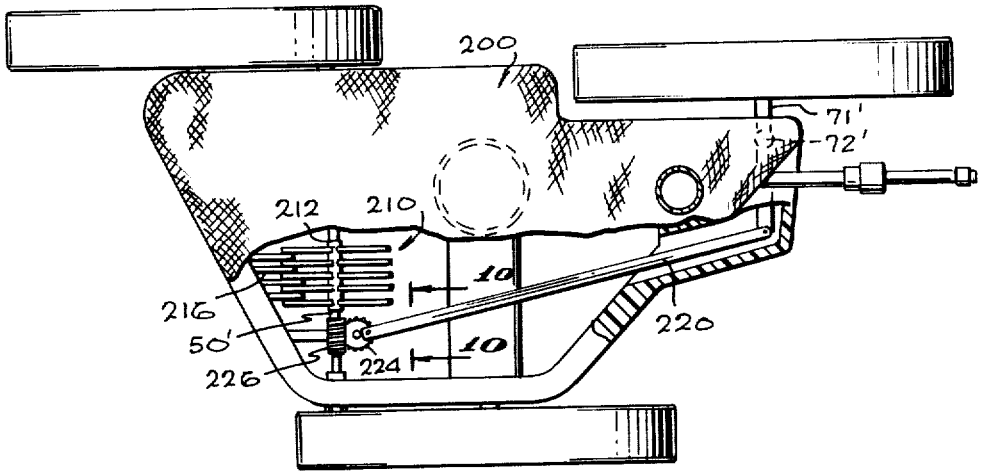
FIG. 8 is a plan view partially broken away illustrating an alternative arrangement including a linkage coupling the turbine to the third wheel to cause random steering and a means for pulverizing leaves and other debris sucked into the collection basket.
Figure 10:
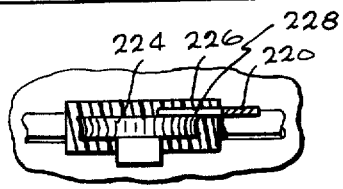
FIG. 10 is a sectional view taken substantially along the plane 10—10 of FIG. 8.
Figure 9:
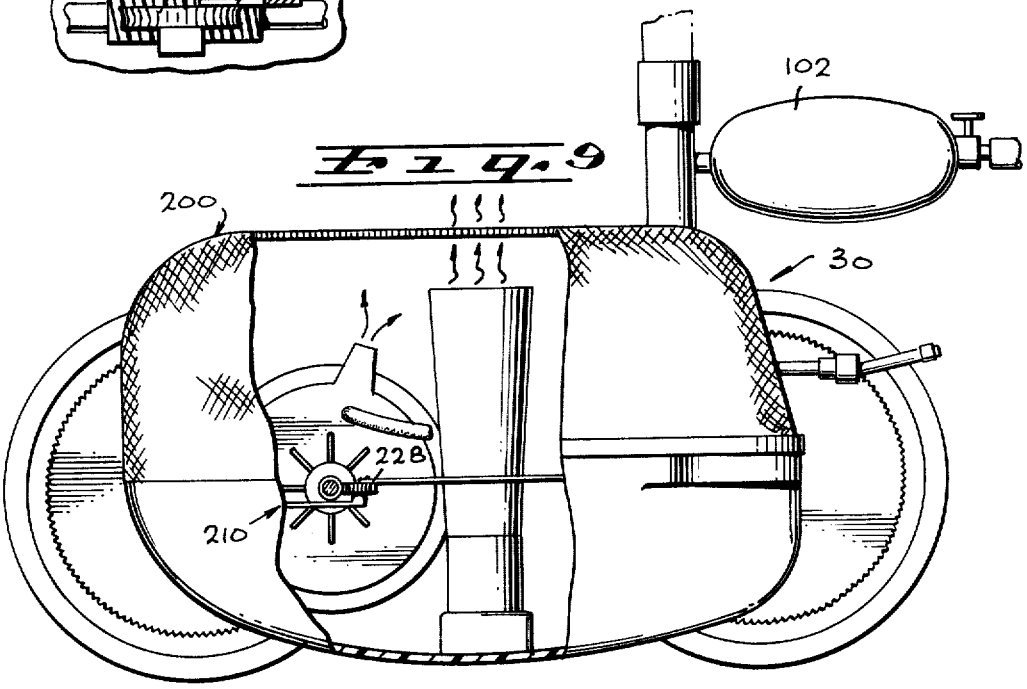
FIG. 9 is a side elevation, partially broken away, of the pool cleaner of FIG. 8.

Utilization of the arrangement of FIGS. 8–10 contemplates that a user remove the dome 200 and then clean the debris from the pan shaped frame structure. In both the arrangement of FIGS. 8–10 and the arrangement of FIGS. 2–7, the mesh size for the water permeable material should be selected to suit a particular set of conditions. For example, in pool situations where many leaves are encountered, it would be desirable to utilize, material with relatively large holes so as to contain most of the leaves and enable the water to freely flow therethrough to suspend the rest of the debris for removal by the filter system. On the other hand, a pool with few leaves but a heavy silt problem would preferably use a very closely woven container material to remove the silt and reduce the load on the filter system.

In using the subject pool cleaner, it has been recognized that as the leaves collect within the container, the high velocity water stream discharged from the upper end of the venturi tube continually beats the leaves against the container screen material. As a consequence, the leaves are pulverized into fine particles which pass through the screen material and go into suspension in the water from which they can be removed by the pools regular filtration system. As a result of this action, the frequency with which the debris must be removed from the container is considerably reduced. In pool situations with a greater then normal leaf problem a pulverizing means 210 (FIGS. 8 and 9) can be incorporated in the container to more positively pulverize the leaves. More particularly, as shown in FIG. 8 a collar 212 carrying a plurality of radially extending blades 214 can be mounted on turbine shaft 50'. As the shaft 50 rotates, the blades 214 move past fixed blade 216 shredding leaves therebetween.

In order for the pool cleaner to function effectively, it should travel in a highly random manner so as to substantially cover the entire vessel surface. Various factors operating on the car depicted in FIGS. 2–7 will tend to produce this random motion. Such factors include the vessel surface terrain, the action of the whip hose 96 and the direction of the nozzle 90. However, it is recognized that if necessary, for certain pool situations, means can be incorporated in the car for positively randomizing the car motion. For example, attention is called to FIGS. 8–10 which illustrates one such means for varying the plane of rotation of the wheel 36c as the car moves. In the embodiment of FIGS. 8–10, the axle 71' of the wheel 36c is pivoted around pin 72' by a link 220 coupled between the axle 71' and gear 224. The gear 224 is engaged with worm gear 226 secured to turbine shaft 50'. As shaft 50' rotates, gears 224 and 226 rotate around their axes thus moving the end 228 of link 220 in a small circle. This alternately pulls and pushes the free end of axle 71' thus pivoting it about pin 72'.

It should be recognized that other arrangements can also be employed for achieving the random motion produced by the embodiment of FIGS. 8–10. For example only, the direction of the nozzle 90 can be varied as the car moves, a movable rudder can be employed and/or the flow rate through the sweep hose can be varied.

From the foregoing, it will be recognized than an improved swimming pool cleaner has been disclosed herein which is capable of randomly traveling on the pool vessel surface and collecting debris therefrom as well as dislodging debris from the surface for collection by the pools standard filtration system. Although a preferred embodiment of the invention has been illustrated herein, it is recognized that numerous variations and modifications can be made therein without departing from the spirit and scope of the invention. Thus, for example only, tractions means other than the rough wheels can be employed for increasing traction area or for facilitating travel of the car over low obstructions, such as a hose. Similarly, means can be provided for changing drive direction in special pool situations where the car could get stuck against some obstacle. It should also be recognized that although the preferred embodiments of the invention illustrated herein employ a booster pump 70 for optimum performance, the booster pump could be eliminated in a low cost system and the turbine could be driven by water flow from the main pump.

What is claimed is:

1. A swimming pool cleaner including a car adapted to travel underwater on the surface of a pool vessel;

said car including a frame supported on traction means for engaging said pool vessel surface;

water supply means carried by said car having an inlet and at least one outlet;

turbine means carried by said car coupled to said water supply means outlet;

drive means coupling said turbine means to said traction means for drivingly rotating said traction means in response to water supplied to said turbine means for propelling said car along said vessel surface;

thrust means carried by said car for producing a water flow having a component directed to produce a reaction force on said car acting to thrust said traction means against said pool vessel surface;

debris container means and debris suction means carried by said car;

said debris container means including an entrance opening;

said debris suction means including a suction entrance located on said car in close proximity to said vessel surface and a suction exit coupled to said debris container means entrance opening.

2. The swimming pool cleaner of claim 1 wherein said debris suction means includes a venturi tube having an exit end coupled to said debris container means entrance opening and an entrance end located in close proximity to said vessel surface;

said debris suction means further including an orifice coupled to one of said water supply means outlets and directed towards the throat of said venturi tube for discharging a water flow therein.

3. The swimming pool cleaner of claim 2 wherein said venturi tube is oriented to discharge said water flow in a direction having a component extending normal to said vessel surface.

4. The swimming pool cleaner of claim 1 wherein said debris container means is defined by a water permeable material.

5. A swimming pool cleaner, useful in a system employing a water pump for withdrawing water from a swimming pool and for returning a pressurized water supply flow, said cleaner comprising:

a frame structure supported on movable traction means adapted to engage the pool vessel surface;

turbine means including a power output member supported on said frame structure;

supply hose means for coupling said water supply flow from said water pump to said turbine means for driving said power output member;

means coupling said power output member to said traction means for moving said frame structure in response to said water supply flow driving said power output member;

thrust means supported on said frame structure and coupled to said supply hose means for discharging a portion of said water supply flow in a direction having a component extending normal to said vessel surface to produce a reaction force in a direction to increase the traction between said traction means and vessel surface;

suction means carried by said frame structure and having a suction opening located to be in close proximity to said pool vessel surface;

a water permeable debris container carried by said frame structure; and means communicating said suction opening with said debris container.

6. The swimming pool cleaner of claim 5 wherein said means communicating said suction opening with said debris container comprises a venturi tube; and means for discharging a portion of said water supply flow proximate to the throat of said venturi tue to produce a reduced pressure thereat.

7. The swimming pool cleaner of claim 5 including means mounted in said container for pulverizing debris.

8. The swimming pool cleaner of claim 7 wherein said means for pulverizing includes at least one movable blade coupled to said power output member.

9. In a swimming pool cleaning system including a car adapted to travel underwater on the surface of a pool vessel, the improvement comprising:

a debris container carried by said car and having an entrance opening;

debris suction means carried by said car including a suction entrance disposed in close proximity to said vessel surface and a suction exit coupled to said debris container means entrance opening; and pulverizing means mounted in said container for pulverizing debris.

10. A swimming pool cleaner comprising:

a car including a frame supported on wheel means for engaging the surface of a swimming pool vessel;

propelling means carried by said car for propelling said car along said vessel surface;

said wheel means including first and second parallel wheels each mounted for rotation on said frame and offset with respect to one another so that a line projected between the axes thereof is skewed with respect to the planes of said first and second wheels, at least one of said wheels extending beyond said frame in the direction said car is propelled for engaging vertical surfaces of said swimming pool vessel; and debris suction means carried by said car and including a suction entrance located on said car in close proximity to said vessel surface.

11. The swimming pool cleaner of claim 10 further including:

debris container means carried by said car and including an entrance opening; and wherein said debris suction means includes a suction exit coupled to said debris container means entrance opening.

12. The swimming pool cleaner of claim 11 wherein said debris container is formed of water permeable material.

13. The swimming pool cleaner of claim 11 further including:

pulverizing means mounted in said container for pulverizing debris.

14. A swimming pool cleaner comprising:

a car including a frame supported on traction means for engaging the surface of a swimming pool vessel;

water supply means carried by said car having an inlet and an outlet;

propelling means carried by said car for propelling said car along said vessel surface;

thrust means carried by said car for producing a water flow having a component directed to produce a reaction force on said car acting to thrust said traction means against said pool vessel surface, said thrust means including a nozzle coupled to said water supply means outlet for discharging a water flow in a direction having a component extending normal to said vessel surface; and debris suction means carried by said car and including a suction entrance located on said car in close proximity to said vessel surface.

15. The swimming pool cleaner of claim 14 including adjustable means for supporting said nozzle in different orientations.

16. The swimming pool cleaner of claim 14 wherein said debris suction means includes a tube having entrance and exit openings at opposite ends thereof, said tube entrance opening communicating with said suction entrance; and wherein said thrust means nozzle is disposed in said tube for discharging a water flow from proximate to said tube entrance opening toward said tube exit opening to produce a suction at said tube entrance opening.

17. The swimming pool cleaner of claim 14 further including:

debris container means carried by said car and including an entrance opening; and wherein said debris suction means includes a suction exit coupled to said debris container means entrance opening.

18. The swimming pool cleaner of claim 17 wherein said debris container is formed of water permeable material.

19. The swimming pool cleaner of claim 17 further including:

pulverizing means mounted in said container for pulverizing debris.

20. A swimming pool cleaner comprising:

a car including a frame supported on traction means for engaging the surface of a swimming pool vessel;

water supply means carried by said car having an inlet and first and second outlets;

propelling means carried by said car for propelling said car along said vessel surface, said propelling means including a nozzle coupled to said water supply means first outlet for discharging a water flow having a component directed substantially parallel to said vessel surface;

thrust means carried by said car including a nozzle coupled to said water supply means second outlet for discharging a water flow having a component directed normal to said vessel surface to produce a reaction force on said car acting to thrust said traction means against said vessel surface; and debris suction means carried by said car and including a suction entrance located on said car in close proximity to said vessel surface.

21. The swimming pool cleaner of claim 20 further including:

debris container means carried by said car and including an entrance opening; and wherein said debris suction means includes a suction exit coupled to said debris container means entrance opening.

22. The swimming pool cleaner of claim 20 wherein said debris suction means includes a tube having entrance and exit openings at opposite ends thereof, said tube entrance opening communicating with said suction entrance; and wherein said thrust means nozzle is disposed in said tube for discharging a water flow from proximate to said tube entrance opening toward said tube exit opening to produce a suction at said tube entrance opening.

23. A swimming pool cleaner comprising:

a car including a frame supported on traction means for engaging the surface of a swimming pool vessel;

water supply means carried by said car having an inlet and first and second outlets;

propelling means carried by said car for propelling said car along said vessel surface, said propelling means including means for discharging a water flow having a component directed substantially parallel to said vessel surface; and suction means carried by said car and including a suction entrance located on said car in close proximity to said vessel surface, said suction means including a tube having entrance and exit openings at opposite ends thereof, said tube entrance opening communicating with said suction entrance, and a nozzle disposed in said tube for discharging a water flow from proximate to said tube entrance opening toward said tube exit opening to produce a suction at said tube entrance opening.

24. The swimming pool cleaner of claim 23 wherein said nozzle is oriented to discharge said water flow in a direction having a component normal to said vessel surface to produce a reaction force acting to thrust said traction means against said vessel surface.

* * * * *

UNITED STATES PATENT OFFICE

CERTIFICATE OF CORRECTION

Patent No. 3,936,899 Dated February 10, 1976

Inventor(s) Melvyn L. Henkin et al.

It is certified that error appears in the above-identified patent and that said Letters Patent are hereby corrected as shown below:

On the cover sheet item [62] delete "abandoned" and insert -- now U. S. Patent No. 3,822,754 --.

Column 1, line 55, after "wheels" insert -- for increasing traction between the wheels --. Column 2, line 33, "diverging" should read -- diverting --. Column 3, line 51, "panel" should read -- pool --. Column 4, line 37, "mainfold" should read -- manifold --; line 37, "pressurized" should read -- pressured --. Column 6, line 16, "thrust" should read -- throat --; line 36, "pressurized" should read -- pressured --; line 40, "cause" should read -- caused --. Column 8, line 15, "rough" should read -- round --. Column 9, line 3, "pressurized" should read -- pressured --; line 34, "tue" should read -- tube --.

Signed and Sealed this twenty-fifth Day of May 1976

[SEAL]

Attest:

RUTH C. MASON
*Attesting Officer*

C. MARSHALL DANN
*Commissioner of Patents and Trademarks*